US005752570A

United States Patent [19]

Shaposhnikov et al.

[11] Patent Number: 5,752,570

[45] Date of Patent: May 19, 1998

[54] METHOD AND DEVICE FOR PRODUCTION OF HYDROCARBONS

[75] Inventors: Vladimir Shaposhnikov, Brooklyn; Semen Tseytlin, Middle Village, both of N.Y.

[73] Assignee: Petroenergy LLC, New York, N.Y.

[21] Appl. No.: 742,409

[22] Filed: Nov. 4, 1996

[51] Int. Cl.[6] ..... E21B 43/00

[52] U.S. Cl. ..... 166/372; 166/162

[58] Field of Search ..... 166/311, 369, 166/371, 372, 162

[56] References Cited

U.S. PATENT DOCUMENTS

| | | | |
|---|---|---|---|
| 4,086,030 | 4/1978 | David | 417/88 |
| 4,194,567 | 3/1980 | Marais | 166/311 |
| 5,105,889 | 4/1992 | Misikov et al. | 166/372 |
| 5,535,767 | 7/1996 | Schnatzmeyer et al. | 417/109 X |
| 5,597,042 | 1/1997 | Tubel et al. | 166/250.01 |

*Primary Examiner*—Frank Tsay

*Attorney, Agent, or Firm*—Ilya Zborovsky

[57] ABSTRACT

For production of hydrocarbons from a hydrocarbon formation through a well in a condition of fluctuations in the formation pressure, in addition to transformation of a formation fluid into a gas-liquid flow, the bottomhole pressure is automatically regulated at a level higher than saturation pressure of the formation fluid, regardless of any changes in properties of the formation and the formation fluid. At the same time, the speed of the flow of the formation fluid from the bottomhole to a location of transformation is maintained automatically at a level to be sufficient for the transformation of the formation fluid into the gas-liquid flow.

6 Claims, 3 Drawing Sheets

METHOD AND DEVICE FOR PRODUCTION OF HYDROCARBONS

BACKGROUND OF THE INVENTION

The present invention relates to a method of and a device for production of hydrocarbons, in particular oil from wells.

Various methods and devices are known for production of hydrocarbons from wells. One such method is a natural flow method of production of hydrocarbons from wells according to which a formation fluid flows from the bottomhole to the wellhead of a well due to natural oil formation pressure and energy of gas dissolved in oil. In the process of the long-time operation the well by the natural flow method, the formation pressure drops until it is insufficient for lifting oil to the wellhead, and the well stops flowing. In that case a common secondary method of secondary oil production is used, for example, gas-lift. Maximum flow rates lead to a decrease in the bottomhole pressure. However, the decrease in the bottomhole pressure below the saturation pressure results in oil degassing in the near-bottomhole zone of the formation, clogging of pore space of the reservoir by gas, and, as a consequence, in a reduction of the formation permeability and eventually in oil recovery decrease. To prevent the latter negative effect, a pressure is built-up at the wellhead, for which purpose installed is a choke with its inner diameter selected so as to provide the required bottomhole pressure, which may result in a certain limitation of the oil flow rate. However, such maintenance of the bottomhole pressure at a level not lower than the saturation pressure, performed from the wellhead, also may stop the flowing of the well and cause the necessity to use a gas-lift or a pumping method of oil production.

According to the gas-lift method of oil production, a compressed gas is injected at a certain depth into the production tubing to aerate the formation fluid in the tubing upon a decrease in the well pressure due to lifting of the flow, hereby reducing the fluid's weight, so that the aerated fluid flows up towards the wellhead, and the bottomhole pressure reduces. At the same time, the depression (a difference between the fluid pressure in the reservoir and in the bottomhole) is increased and the fluid starts to flow from the formation through the well from its bottomhole to the wellhead. However, such method of the formation fluid is characterized by an increased cost of both the fluid produced, and a higher production cost due to expenses on gas, power-intensive equipment, control systems. Besides, efficiency of the gas-lift method is relatively low.

Another method of oil production is disclosed in a U.S. Pat. No. 5,105,889. According to this method of oil production from wells with a reduced formation pressure, a gas dissolved in oil is forcibly liberated from the oil flow in the bottomhole part of a well, and the oil flow is hereby transformed into a finely-dispersed gas-liquid flow so that the pressure of such gas-liquid column from the site of the transformation to the wellhead, in sum with the wellhead pressure, less friction losses, becomes lower than the saturation pressure and lower than the difference between the bottomhole pressure and the pressure of the fluid column from the depth of the formation occurrence to the location of said transformation. In case of such oil transformation in a well, oil flows to the wellhead due to energy of gas dissolved in oil, without any additional energy sources, even in wells with a reduced formation pressure. According to this method, to prevent oil degassing in the bottomhole zone of the well and consequent decrease of the oil production, the bottomhole pressure is established and maintained to be higher than the saturation pressure by means of throttling; at the same time, the inner cross section of the flow channel is reduced and the flow speed is consequently increased to provide a drop in the flow pressure below the saturation pressure, hereby forcing degassing in the whole fluid column of the well. A device for performing this method consists of a body with a nozzle installed in the body and aligned with the well, which body is fixed hermetically in the well tubing, and Venturi tubes installed in the body above the nozzle and aligned with it, for forced liberation of a gas dissolved in the formation fluid and transformation of the flow coming out of the nozzle into a finely dispersed gas-liquid flow. In this device said Venturi tubes are installed in the upward sequence and aligned.

The above method is more advanced than gas-lift, since it provides creation in a well of a gas-liquid flow of a lower density; stabilization of the bottomhole pressure, preventing oil degassing in the formation and at the bottomhole; maintenance of the wellhead pressure at a level providing the gas-liquid flow to the wellhead and preventing its phase separation, to hereby prolong or restore the flowing regime of the well without any additional energy sources, to reduce production cost, and to increase efficiency of oil production in general.

During a process of oil production various hydrodynamic and gas dynamic changes occur which influence operation of the producing wells, such as a drop in the formation pressure due to the oil intake from the reservoir, which results in a reduction of well flow rates; a drop in the formation pressure due to an interference of changes occurring in the adjacent wells, such as shutting in a well for a workover, introduction of a new well, etc. which also result in a reduction of the oil production; a reduction of the gas-in-oil ratio, an increase of the water cut in the production; a depletion of separate formation layers, which also lead to a decrease in the well flow rates; fracture healing in porous reservoirs in the bottomhole zone of the formation; an increase in the formation pressure due to pumping of the water through injection wells, etc. All said natural and technogenic processes occur in the oil fields all the time and affect well operation to some or the other degree. If said changes, occurring irregularly in different oil fields and wells are not taken in consideration, it may lead to a drop in the formation pressure, a decrease in the differential pressure, a drop in the bottomhole pressure below saturation pressure, an increase in the water-in-oil ratio, a change of the gas content and the saturation pressure, which consequently may result in a reduction of the well flow rate, an accelerated gas breakthrough, an unstable well operation, even the wells shutdown. In the event of the above, more expensive and less efficient secondary mechanized methods of oil production are used.

According to the method disclosed in the aforementioned U.S. patent, it is possible to partially control said processes by means of a bottomhole and a wellhead devices: a wellhead valve which automatically regulates the proportion of gas-liquid mixture from the site of its origination in the well to the wellhead, preventing creation of an annular mist flow regime, and the bottomhole device which permits correction of the well operation by means of a periodical replacement of Venturi tubes in the device with the new ones with different parameters in response to any changes in properties of the formation and the formation fluid, for example, changes in the bottomhole pressure, gas and water content in the flow, the well flow rates, and so on. The well must be shut in for such replacements, additional expenses on the new equipment occur, the well operation becomes more complicated and less efficient due to a step-by-step change of the device parameters.

SUMMARY OF THE INVENTION

The object of this invention is to develop an efficient method of and a device for production of hydrocarbons, which avoid the disadvantages of the prior art.

In keeping with this object and with the others which will become apparent hereinafter, one feature of the present invention resides, briefly stated, in a method of production of hydrocarbons, in accordance with which a flow of a hydrocarbon-containing formation fluid is produced at the bottomhole of a well, the flow of the formation fluid is transformed at a location of transformation into a finely-dispersed gas-liquid flow, with a liberated gas forming a part of the gas-liquid flow, so that a column of the formation fluid is formed in the well from the depth of the formation to the location of transformation while a column of the finely dispersed gas-liquid flow with a liberated gas is formed in the well between the location of transformation and the wellhead, and in accordance with the new features of the present invention, the pressure of the fluid column of the formation fluid at the bottomhole of the well is maintained automatically higher than the saturation pressure, substantially independently from any changes in the properties of the formation and the formation fluid. Also, during the aforesaid automatically maintaining step, the speed of the formation fluid flow below the location of transformation is maintained at a level providing transformation of the formation fluid flow into the finely-dispersed gas-liquid flow at the location of transformation.

In accordance with another feature of the present invention, the device for producing a hydrocarbon-containing formation fluid flow is proposed which includes appropriate means for producing a formation fluid flow at the bottomhole of the well, means for transforming the formation fluid flow at a location of transformation into a finely-dispersed gas-liquid flow, and in accordance with the inventive feature, a means is provided for automatic maintaining the pressure of the formation fluid column at the bottomhole higher than the saturation pressure, substantially independently from any changes in properties of the formation and the formation fluid. The means of automatic maintaining can simultaneously maintain the speed of the formation fluid flow at a level providing the transformation of the formation fluid flow into the finely-dispersed gas-liquid flow with a liberated gas forming a part of the gas-liquid flow.

When the method is performed and the device is designed and applied in accordance with the present invention, they avoid the disadvantages of the prior art, and provide highly advantageous results. In accordance with the invention, the bottomhole pressure is permanently maintained at a level higher than the saturation pressure automatically, and therefore the bottomhole zone of the formation is not being clogged by gas. At the same time, a stable gas-liquid flow is formed and maintained automatically from the location of the flow transformation to the wellhead, so that the well operates during a long period of time regardless of changing conditions of the formation and the formation fluid, such as the formation pressure, gas and water content in the flow, fracture healing in the bottomhole zone of the formation, etc. The maintenance of the bottomhole pressure and the stable gas-liquid flow is performed automatically while the inventive device stays installed in the well, so that no replacement of the installed device with a new one is required. As a result, a continuity of the well operation and an increase in the oil production of the formation as a whole are obtained. The aforesaid control of the bottomhole pressure and the gas-liquid flow is performed in the bottomhole zone of the well between the bottomhole zone of the formation and the location of transformation of the formation fluid flow into the gas-liquid flow.

The novel features which are considered as characteristic for the present invention are set forth in particular in the appended claims. The invention itself, however, both as to its design and its method of operation, together with the additional objects and advantages thereof, will be best understood from the following description of specific embodiments when read in connection with the accompanying drawings.

DESCRIPTION OF PREFERRED EMBODIMENTS

Figure 1:
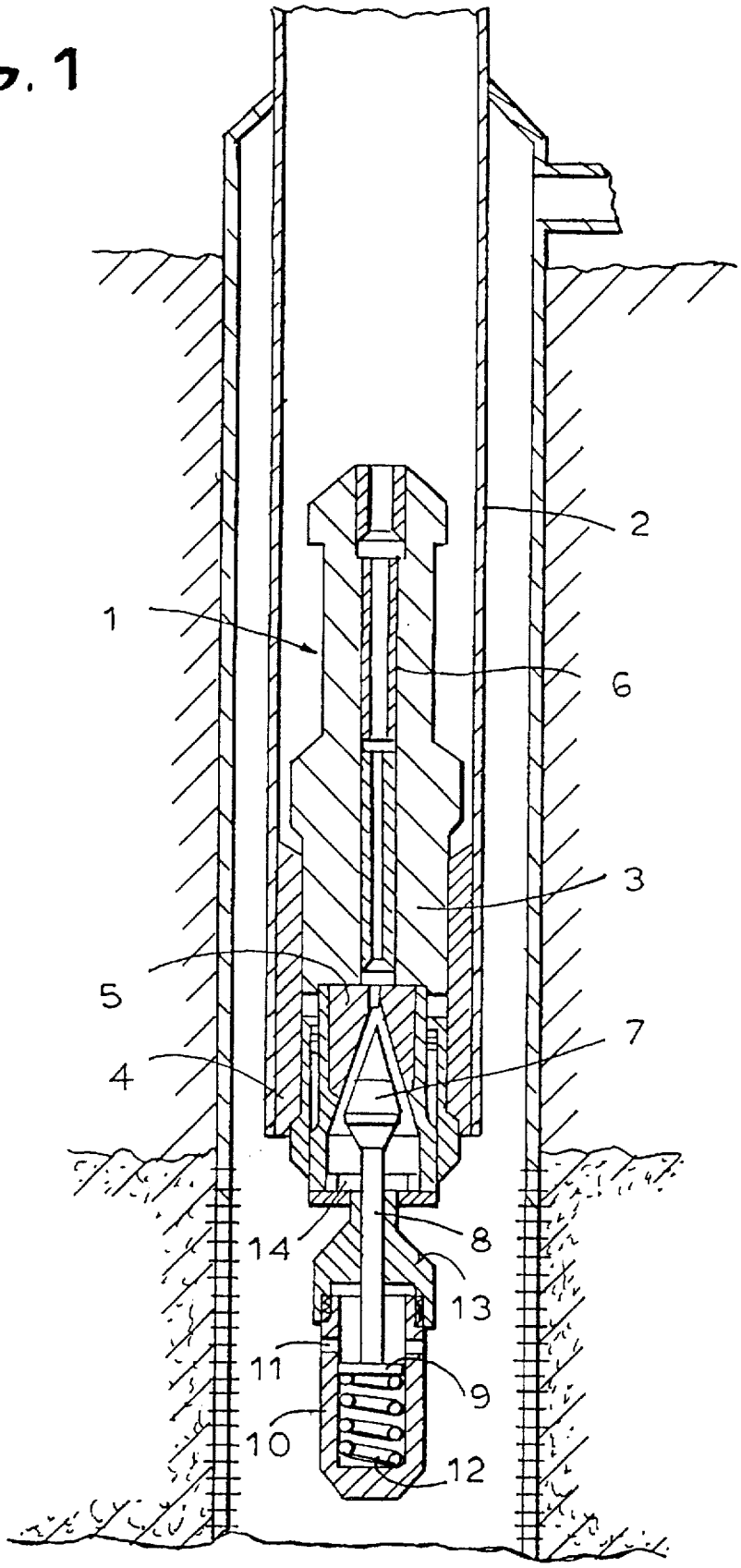
FIG. 1 is a view schematically showing a device for production of hydrocarbons in accordance with the present invention in a well.
Figure 2:
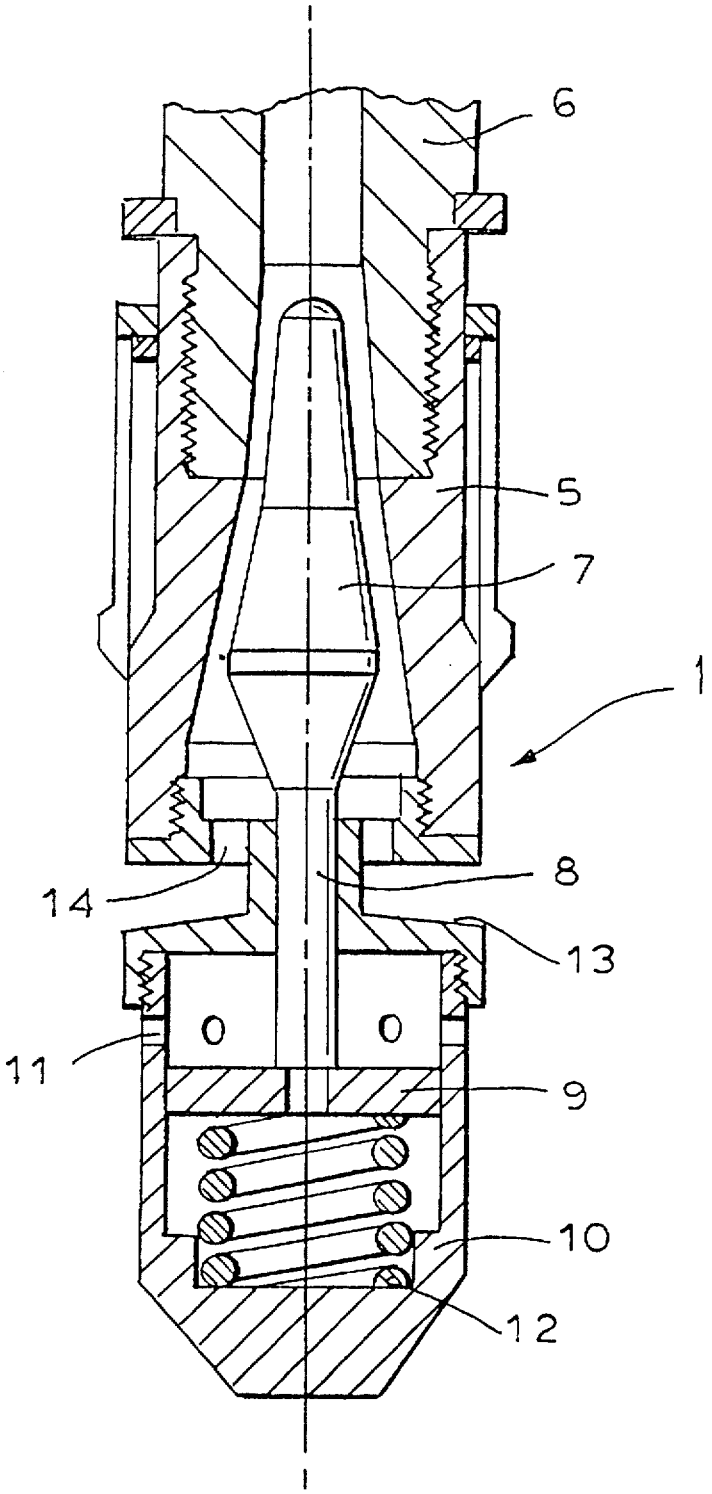
FIG. 2 is a view showing the inventive device for production of hydrocarbons on an enlarged scale.

A device for production of hydrocarbons in accordance with the present invention which is utilized to implement the inventive method of production of hydrocarbons is identified as a whole with reference numeral 1 and mounted in the flow tubing 2 of a well. In particular, a body 3 of the device 1 is hermetically secured in a nipple 4 of the flow tubing 2 of the well. During operation of the well, the formation fluid flows from the formation through holes in the well casing into the bottomhole zone of the well to be transported to the wellhead. The device 1 is provided with a means for transformation of the formation fluid into a finely-dispersed gas-liquid flow. The transformation means includes a nozzle 5 and a Venturi flow means including a plurality of Venturi tubes 6 which form a channel expanding stepwise upwardly. The nozzle 5 is mounted in the body 3 coaxial with the well and oriented so that its outlet hole reduces upwardly. It forms a high-speed flow of the formation fluid. The Venturi tubes 6 are arranged above the nozzle 5 and aligned with it so as to provide a rarefaction causing the forced liberation of the gas dissolved in the formation fluid, so as to produce a finely-dispersed gas-liquid flow. The Venturi tubes 6 are installed one over another and aligned. A collet type holder can be used for securing the body 3 of the device to the nipple 4 of the flow tubing 2.

In accordance with the present invention, the device is provided with a means of automatic maintaining the bottomhole pressure of the formation fluid higher than the saturation pressure substantially independently from any changes in properties of the formation and the formation fluid. The automatic maintaining means includes a valve member 7 which is connected by a connecting rod 8 with a piston 9. The piston 9 is arranged displacedly in a cylinder 10 provided with openings 11 and is spring biased by a spring 12 towards the nozzle 5. The cylinder 10 can be connected with the nozzle 5 by a coupling 13 provided with the through openings 14. As illustrated by FIG. 1, the valve member 7 has a conical external surface, while the nozzle 5 has a conical inner surface, defining an inner conical opening in which the valve member 7 is located.

The method in accordance with the present invention is performed and the device in accordance with the present invention operates as follows:

When the flow is initiated in the well, the formation fluid flows up from the bottomhole due to a pressure difference below and above the device, it passes through the nozzle 5 and forms a high-speed formation fluid flow so that potential energy of the flow converts into kinetic energy, the high-speed flow then passes through the tubes 6 so that its pressure drops and the gas dissolved in the formation fluid is liberated in the form of small bubbles and hereby the formation fluid is transformed into a finely-dispersed gas-liquid flow which, due to an expansion of its volume, rises up to the wellhead. During the well operation a column of the formation fluid is formed in the well from the depth of the formation to the location of transformation of the formation fluid into the gas-liquid flow, while a column of the finely-dispersed gas-liquid flow with the liberated gas is formed in the well between the location of transformation and the wellhead. During this process the formation fluid pressure at the bottomhole has to be maintained at a level higher than the saturation pressure to prevent clogging pores of the formation with gas, and the speed of the formation fluid has to be maintained high enough to permit its transformation into the gas-liquid flow.

However, a drop in the formation fluid pressure may lead in known methods to a drop in the bottomhole pressure below the saturation pressure, and also to a decrease in the speed of the formation fluid flow. At the same time, in the inventive device when the pressure in the formation reduces, the spring 12 is relaxed, and the connection rod 8 together with the valve member 7 is displaced upwardly towards the nozzle 5. Thereby the space between the inner conical surface of the nozzle 5 and the external conical surface of the valve member 7 is reduced and the throughflow cross section of the gap between these conical surfaces is reduced as well. As a result, the pressure of the formation fluid is maintained at the bottomhole practically permanent at a level higher than the saturation pressure, and the speed of the formation fluid flow in the nozzle 5 increases so that in the Venturi tubes 6 are maintained required conditions for producing of the gas-liquid flow and its lifting to the wellhead.

The forced liberation of the gas dissolved in the formation oil which is performed by aforesaid throttling, is based on the following conditions. It is assumed that the bottomhole zone pressure $P_{bh}$ is higher than the saturation pressure $P_{sat}$ $$P_{bh}>P_{sat}$$

and the well fluid is a uniform, non-compressible liquid, $$\rho_1+\rho_w\beta+\rho_0(1-\beta)=\text{const}=\rho, \text{ wherein}$$

$\rho_1$, $\rho_w>\rho_0$—density of liquid, water and oil and $\beta$ is oil water content.

When the fluid flows from the narrowing nozzle 5 into the first Venturi tube 6, must be maintained the following condition of Bernoulli equation:

$$P_1+\rho V_1^2/2=P_2+\rho_2^2/2 \quad (1)$$

wherein $P_1$ and $P_2$ is the pressure before and after the Venturi tube, and $V_1$ and $V_2$ is the speed of the flow below and after the tube. A portion of static pressure or potential energy will be converted into dynamic pressure or kinetic energy. This will occur because of the substantial change in a narrowing of the passage cross section. During this process, the law of conservation of matter must be maintained in case of non-compressible liquid in accordance with the following formula:

$$\rho_1 V_1 S_1=\rho_2 V_2 S_2$$

$$V_1 S_1=V_2 S_2=q,$$

as $\rho_1\approx\rho_2$;

wherein q is a volume liquid rate, $S_1$—is a cross section of the passage before the device, and $S_2$ is a cross section of the Venturi tube.

In order to provide an active liberation of the gas, it is necessary that the pressure in the first Venturi tube should be:

$$P_2<P_{sat} \quad (2)$$

By substituting this into formula (1) the following formula is obtained:

$$P_2=P_{1-\rho/2\cdot q^2/S_1^2((S_1/S_2)^2+1)} \quad (3)$$

Using (2) and (3) it is possible to calculate a value of the cross section of the first Venturi tube to satisfy the condition (3), and therefore the condition of the gas liberation in the tube.

A considerable reduction of the passage cross section leads to an increase in the pressure losses in accordance with the following formula:

$$\Delta P_{tb}=L_1\lambda\rho V^2/2D_1 \quad (4)$$

wherein $\lambda$ is a friction coefficient dependent on the Reynolds number, $D_1$ is a diameter of the first Venturi tube, and $L_1$ is a length of the first Venturi tube. As the pressure losses are related to the bottomhole pressure $P_{bh}=f(\Delta P_{tb})$, the length of the tube allows to regulate the value of the bottomhole pressure within the wide limits, usually $\Delta P_{tb}=(100\div1000)$ psi.

Therefore, using the formula (4) it is possible to calculate the length $L_1$ of the first tube.

From the first Venturi tube a partially degassed fluid flows into the second Venturi tube with a greater cross section ($D_2$, $L_2$) in which the speed of the fluid is reduced and the fluid flow is stabilized. The values of $D_2$ and $L_2$ are calculated on the basis of the same physical theory as of $D_1$ and $L_1$, with the gas presence taken into account, or in other words considering $\rho\neq$ constant.

After the aerated fluid flows into the flow tubing, its speed further reduces, but, due to a specific flow of a multi-phase fluid, the liberated gas dissolves back in the liquid only partially. Therefore, the whole column of fluid from the device to the wellhead becomes aerated and has a lower density and weight. Potential energy of the dissolved gas converts into kinetic energy and lifts the formation oil in a form of the finely-dispersed gas-liquid flow from the location of the flow transformation to the wellhead. Described here principle of operation of the inventive method and the device is similar to the principle of operation of the method and the device disclosed in the above-mentioned U.S. patent.

In order to perform the method in accordance with the present invention and to operate the inventive device, the following example of realization of the inventive method is presented hereinbelow.

Figure 3:
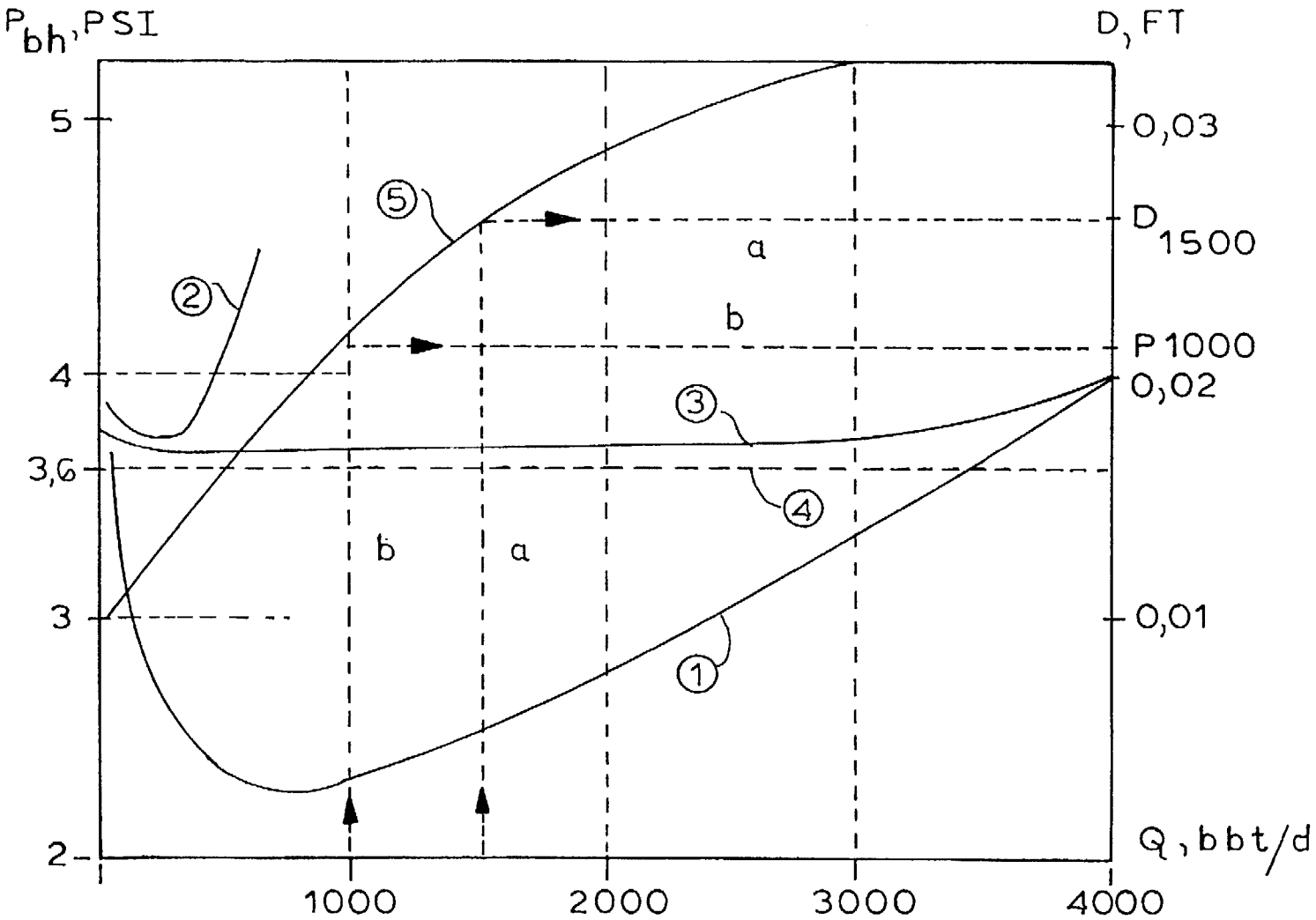
FIG. 3 is a view schematically illustrating operating parameters of a method for production of hydrocarbons in accordance with the present invention in comparison with the existing method.

The inventive method is realized in a well with the inner tubing diameter D=0.166 ft, and a productive formation located at the depth H=12600 ft. Oil density API=37, and viscosity of the degassed oil μ=2 cPz. Relative density of the gas is equal to 0.78. Water gravity is equal to 1.0. Temperature at the bottomhole is equal to 192°. Gas factor GOR=1300 scf/bbl. Water content in oil WOR=0.23. The wellhead pressure is maintained $P_w$=320 psi to prevent the well "choking" within the whole range of the well productivity: 60–3860 bbl/d. The saturation pressure is $P_{sat}$≈3580 psi. The main criterion of the efficient well operation is the condition that the bottomhole pressure is greater than the saturation pressure: $P_{bh}>P_{Sat}$, but this pressure difference must be minimal. Applying some known methods which deal with a two-phase mixture flowing in vertical pipes, it is possible to calculate a characteristic curve of the oil lift, which is shown in FIG. 3. The abscissa axis in FIG. 3 defines the range of the well productivity from 0 to 4000 barrels per day, the left coordinate axis defines the bottomhole pressure or in other words the pressure at the bottomhole of the well within the range of 2000–5000 psi, and the curves 1, 2, 3, 4 correspond to this axis; the right coordinate axis defines a flow cross section of inlet of the nozzle 5 which is being changed by a displacement of the valve member 7, and is measured in feet within the range of 0–0.03 feet, this axis corresponds to the characteristic curve 5 in FIG. 3. In FIG. 3 the characteristic curve 1 illustrates a lift operation in a conventional well with the range of oil productivity of 55–3300 barrels per day. The bottomhole pressure is lower than the saturation pressure of 3580 psi and therefore the well oil flow is substantially reduced, since in the bottomhole zone occur a degassing and a gas colmatage of the formation.

The characteristic curve 2 illustrates a lift operation in the same well with the device disclosed in the aforesaid U.S. patent installed in it. In this case the well will work in almost the most optimal flow regime within the range of oil productivity of 200–280 barrels per day, with the constant diameter of the inlet of approximately 0.009 ft. In the event that the oil productivity increases or decreases beyond the said range, the bottomhole pressure sharply increases, which leads to a drop in the differential pressure and a failure in the optimal well flow regime.

The characteristic curve 3 illustrates the lift according to the inventive method with the inventive device installed in the well, in which device the valve member 7 is arranged inside the nozzle 5 and moves relative to the nozzle in response to the fluctuations of the fluid pressure in the formation. The diameter of the inlet between the valve member 7 and the nozzle 5 is automatically regulated in accordance with the characteristic curve 5, and as a result fluid pressure at the bottomhole is maintained practically constant at a level of approximately 3730 psi, or somewhat higher than the saturation pressure of 3580 psi, within the whole range of oil productivity from 0 up to 4000 barrels per day.

The characteristic line 4 is a straight line which corresponds to the saturation pressure equal to 3580 psi.

The characteristic line 5 shows the required change of the diameter of the inlet of the nozzle 5 by means of the valve member 7 to suit the changes in oil inflow to the well. The right coordinate axis in FIG. 3 corresponds only to this curve.

As can be seen from the FIG. 3, the condition of optimization will be satisfied provided that the well productivity Q<55 bbl/d, and Q>3300 bbl/d. Using formulas (1), (2), (3), (4) it is possible to calculate the values of $D_1$, and $L_1$ of the device to maintain the conditions of formula (1), and the parameters of the active degassing of the fluid immediately above the device $D_1$=0.009 ft and $L_1$=0.2 ft. The device will maintain the conditions within a small interval of oil productivity 200<Q<280 bbl/d, according to the curve 2 in FIG. 3. In a similar manner as for Q=240 bbl/d, can be calculated the change in the diameter of the inlet of the Venturi tube to satisfy the condition (1) within the whole range of the expected well productivity. The results of the calculations are also illustrated in FIG. 3. The characteristic curve 3 is the curve of the lift according to the inventive device when its inlet diameter changes in conformity with the characteristic curve 5. As a result, it is possible to provide a system which has a characteristic curve of lift (FIG. 3) close to a straight line within a broad range of well productivity changes as well as within a broad range of changes of the other formation parameters. The condition of optimal operation of the system formation-well $P_{bl}>P_{sat}$ is satisfied, and the difference between them is maintained at a minimal level. The aeration always starts immediately above the device. No choking of the well occurs at the wellhead. A stable operation of the is provided, as the lift characteristic curve does not have a falling portion.

It will be understood that each of the described above elements, or two or more together, may also find a useful application on other types of constructions and methods differing from the types described above.

While the invention has been illustrated and described as embodied in a method of and device for recovery of hydrocarbons, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of production of hydrocarbons from a well having a bottomhole and a wellhead and communicating with a formation, the method comprising the steps of producing a flow of hydrocarbon-containing formation fluid from the formation at the bottomhole of the well; transforming the flow of the formation fluid at a location of transformation into a finely-dispersed gas-liquid flow with a liberated gas forming a part of the gas-liquid flow, so that a column of the formation fluid is formed in the well from the depth of the formation to the location of transformation, and a column of the finely-dispersed gas-liquid flow with a liberaged gas is formed in the well between the location of transformation and the wellhead; and additionally, in response to a pressure drop of the formation fluid automatically reducing a flow cross-section and increasing a speed of the flow of the formation fluid, and in response to a pressure increase of the formation fluid, automatically increasing a flow cross section and decreasing the speed of the flow of the formation fluid, thereby automatically maintaining a pressure of the formation fluid at the bottomhole in the well higher than saturation pressure, substantially independently from any changes in properties of the formation and the formation fluid.

2. A method as defined in claim 1, wherein said step of automatically maintaining the pressure of the column of the formation fluid at the bottomhole of the well higher than the saturation pressure, simultaneously includes maintaining the speed of the flow of the formation fluid from the bottomhole to the location of transformation at such a level which insures the transformation of the formation fluid into the finely-dispersed gas-liquid flow with the liberated gas.

3. A method as defined in claim 1, wherein said automatically maintaining step includes maintaining the pressure of the flow of the formation fluid at the bottomhole of the well higher than the saturation pressure so that the pressure of the formation fluid at the bottomhole is lower than the pressure of the formation fluid in the formation.

4. A method as defined in claim 1, wherein said step of automatically maintaining the pressure of the formation fluid at the bottomhole of the well higher than the saturation pressure, is performed at a depth which is lower than the depth of the location of transformation of the flow of the formation fluid into the finely-dispersed gas-liquid flow with the liberated gas.

5. A device for production of hydrocarbons from a well having a bottomhole and a wellhead and communicating with a formation, the device comprising means for transforming a flow of hydrocarbon-containing formation fluid at a location of transformation into a finely-dispersed gas-liquid flow so that a column of the formation fluid is formed in the well form a depth of the formation to the location of the transformation while a gas-liquid column of the finely-dispersed gas-liquid flow with a liberated gas is formed in the well from the location of transformation to the wellhead; and additional means operative so that, in response to a pressure drop of the formation fluid, said additional means automatically reduce a flow cross-section and increase a speed of the flow of the formation fluid, and in response to a pressure increase of the formation fluid, said additional means automatically increase the flow cross section and reduce the speed of the flow of the formation fluid, and thereby automatically maintain the pressure of the formation fluid at the bottomhole of the well higher than the saturation pressure, substantially independently from changes in properties of the formation and the formation fluid.

6. A device as defined in claim 5, wherein said additional means includes at least one nozzle with a cross section reducing in the vertical upward direction, at least one Venturi tube located immediately above and following said nozzle, and a valve member which is automatically movable vertically upwardly and downwardly in said nozzle under the action of the pressure drop or pressure increase of the formation fluid in the formation so as to respectively reduce and enlarge the flow cross section between said valve member and said nozzle.

* * * * *